US010471570B2

(12) United States Patent
Trull, Jr. et al.

(10) Patent No.: US 10,471,570 B2
(45) Date of Patent: Nov. 12, 2019

(54) WET ABRASIVE BLASTING UNIT

(71) Applicants: Daniel A. Trull, Jr., Maurice, LA (US); Daron Scot Trull, Maurice, LA (US)

(72) Inventors: Daniel A. Trull, Jr., Maurice, LA (US); Daron Scot Trull, Maurice, LA (US)

( * ) Notice: Subject to any disclaimer, the term of this patent is extended or adjusted under 35 U.S.C. 154(b) by 0 days.

(21) Appl. No.: 15/424,794

(22) Filed: Feb. 4, 2017

(65) Prior Publication Data

US 2017/0225297 A1 Aug. 10, 2017

Related U.S. Application Data

(60) Provisional application No. 62/291,012, filed on Feb. 4, 2016.

(51) Int. Cl.

| | |
|---|---|
| ***B24C 7/00*** | (2006.01) |
| ***B24C 3/06*** | (2006.01) |
| ***B24C 1/08*** | (2006.01) |

(52) U.S. Cl.

CPC ..... *B24C 7/0084* (2013.01); *B24C 1/086* (2013.01); *B24C 3/06* (2013.01); *B24C 7/0038* (2013.01); *B24C 7/0053* (2013.01); *B24C 7/0076* (2013.01)

(58) Field of Classification Search

CPC ..... B24C 1/086; B24C 3/06; B24C 7/0053; B24C 7/0084; B24C 7/0038; B24C 7/0076

See application file for complete search history.

(56) References Cited

U.S. PATENT DOCUMENTS

| | | | | |
|---|---|---|---|---|
| 799,808 | A * | 9/1905 | Thompson | B24C 7/0046 451/100 |
| 2,200,015 | A * | 5/1940 | Alexandrescu | F16J 9/00 92/158 |
| 3,212,759 | A * | 10/1965 | Brown | B28C 5/123 261/124 |
| 3,704,553 | A * | 12/1972 | Hehr | B24C 7/0046 239/146 |
| 5,244,317 | A * | 9/1993 | Kuboyama | B24C 7/0038 406/136 |
| 6,321,939 | B1 * | 11/2001 | Treat | F16K 17/0433 222/195 |
| 2008/0287039 | A1 * | 11/2008 | Connelly | B24C 3/06 451/38 |

(Continued)

*Primary Examiner* — Marc Carlson

(74) *Attorney, Agent, or Firm* — Law Office of Jesse D. Lambert, LLC

(57) ABSTRACT

An abrasive blasting system has an abrasive container or pot, preferably with a downwardly conically shaped interior bottom surface. A slurry delivery tube is positioned within the pot, with an open bottom end positioned at an operative distance above the bottom of the pot. The slurry delivery tube runs vertically upward and exits the pot, ultimately running to a hose and nozzle. With an abrasive slurry of solid particulate abrasive media and water inside the pot, air pressure is applied within the pot. When a relatively lower pressure is created in the slurry delivery tube, the resulting pressure differential moves the slurry downward within the pot, then upward through the slurry delivery tube, through the hose and ultimately to the nozzle, where it is directed by an operator onto a workpiece. The system is especially useful when using very fine abrasive material.

6 Claims, 11 Drawing Sheets

(56) References Cited

U.S. PATENT DOCUMENTS

| | | | | |
|---|---|---|---|---|
| 2012/0015592 | A1* | 1/2012 | Eliason | B24C 7/0038 451/91 |
| 2016/0023326 | A1* | 1/2016 | Lecompte | B24C 7/0023 451/101 |
| 2017/0348824 | A1* | 12/2017 | Skross | B24C 1/08 |

* cited by examiner

WET ABRASIVE BLASTING UNIT

CROSS REFERENCE TO RELATED APPLICATIONS

This non-provisional United States patent application claims priority to U.S. provisional patent application Ser. No. 62/291,012, filed 4 Feb. 2016, for all purposes. The disclosure of that application is incorporated herein, to the extent not inconsistent with this application.

BACKGROUND

Field of the Invention

This invention relates to wet abrasive blasting, sometimes referred to as vapor blasting. Wet abrasive blasting (most commonly using water) is used in a number of industrial settings to remove rust, scale, and other corrosion from metal surfaces, to prepare them for repair or repainting. In other applications wet abrasive blasting is used to polish, clean, remove paint, and/or to create a suitable surface for a later-applied paint or other coating.

In some respects similar to commonly known sandblasting, wet abrasive blasting uses a combined flowstream of a solid media (the abrasive) mixed with a liquid, usually water, forming in effect a slurry, directed through a restrictive nozzle onto a surface. The advantages of wet abrasive blasting over sandblasting are numerous and known in the relevant art field. Generally, prior art systems applied pressure within a vessel, to force a liquid/abrasive slurry out of the bottom of the vessel, through a discharge line into a hose and ultimately onto the workpiece. This flowpath often resulted in clogging, particularly when very fine abrasives were used.

Prior art wet abrasive blasting systems exhibit a number of problems, including but not limited to difficulties in flowing ultrafine abrasives (i.e. small particle size). In the prior art systems, erratic flow and unacceptable clogging of the system frequently occurs, among other problems.

As is known in the relevant art, the fluid is sent under pressure from a pressurized fluid source (which may be a pressurized pot, as known in the art), through a hose, through a nozzle and onto a surface being treated. The nozzle is positioned by an operator. It is understood that fluid flow must be started and stopped when necessary, and industry regulations may require that some form of remote control system be used to start/stop fluid flow; in particular, such regulations may require a pressure-hold system, such that a lever or trigger must be held down by the operator for fluid to flow out of the nozzle, and if the operator drops or loses control of the controller then fluid flow stops.

Prior art systems included pneumatic and electrical pressure-hold control systems. Pneumatic systems use a pneumatic signal from the operator-held control switch to remotely activate and deactivate the fluid flow at its source, for example at an abrasive blasting pot. Pneumatic systems require one or more pneumatic lines, in addition to the hose through which the fluid flows, running from the controller back to the source. Electrical systems require an electrical wire running from the controller back to the source. It can be readily understood that the additional pneumatic lines or electrical wires adds weight to and generally increases the difficulty of handling the fluid hose. In addition, the pneumatic lines or electrical wires must be dragged around by the operator, exposing them to damage from obstacles, scuffing/ breaking from contact with common industrial area surfaces such as concrete, metal grating, etc.

SUMMARY OF THE INVENTION

An embodiment of the wet abrasive blasting system embodying the principles of the present invention comprises an abrasive media container or "pot" preferably disposed within a protective frame, with the bottom of the pot preferably having a conical shape with the vertex of the cone downward. A pressurized water storage tank may also be contained within the frame. A slurry delivery tube is positioned vertically in the center of the pot, with the bottom end of the slurry delivery tube terminating a short distance above the bottom of the pot. One embodiment may comprise a perforated quill extending upwardly into the slurry delivery tube. Pressurized water can be delivered to the bottom of the pot, namely to the vertex of the conically shaped bottom, through a line, where the water then travels upward through the perforated quill. This may assist in keeping the slurry delivery tube clear and in enhancing flow characteristics. In another embodiment, a perforated air delivery tube is positioned in the abrasive media container, below the slurry delivery tube, for pumping pressurized air into the system and assisting in abrasive media slurry flow.

To use the system, the pot is filled with a desired volume of abrasive media and water to create a slurry. Air pressure is applied to the pot (whether in an upper portion of the pot, or any other location in the pot), which may have some void space therein at the top end. The abrasive media naturally settles to the bottom of the pot. The pot, as noted above, is pressurized with (e.g.) compressed air. When the controller on the slurry delivery hose is actuated, a lower pressure (i.e. lower than the pressure within the pot) is created in the slurry delivery line. The resulting pressure differential between the pressure within the pot, and the pressure within the slurry delivery tube moves the abrasive media/water slurry into the lower end of the slurry delivery tube, then upwardly through the slurry delivery tube to an exit in the upper part of the pot, where it then flows out of the pot through a conduit. Once out of the pot, the abrasive media/water slurry flows through an adjustable metering valve into a pressurized air stream, creating the abrasive media/water/air mixture which can then be directed to the desired work surface, through a nozzle or wand having a fluid delivery controller system for use by an operator. The fluid delivery controller system controls flow of the abrasive media mixture from the delivery hose to the workpiece.

While various fluid delivery controller systems may be used in connection with this invention, one fluid delivery controller system embodying certain of the principles of the present invention comprises, fundamentally, a wireless system utilizing spread spectrum technology, e.g. at 2.4 GHz, with a transmitter at the operator's location which is substantially at the discharge end of the fluid hose; and a receiver at the fluid source end.

In one embodiment of the present invention, the operator has a transmitter with a pressure-hold or "deadman" control. When a trigger or handle is depressed, a wireless signal is sent from the transmitter to a receiver at the fluid source. The receiver in turn activates (opens) suitable valving to permit pressurized fluid flow through the hose, to be directed onto a work surface. When the trigger or handle is released, a wireless signal is sent from the transmitter to the receiver at the fluid source, which in turn activates (closes) the valving to stop fluid flow through the hose. In one embodiment, the transmitter is mounted on the operator's belt or the like, and need not form a part of the hand-held portion of the device.

It is understood that the system comprises further controllers, digital processors, etc. as is necessary. Appropriate pumps, controls, piping, etc. are provided, as described more hereinafter.

DESCRIPTION OF THE PRESENTLY PREFERRED EMBODIMENT(S)

While various abrasive media water blasting systems can embody the principles of the present invention, with reference to the drawings some of the presently preferred embodiments can be described.

Figure 1:
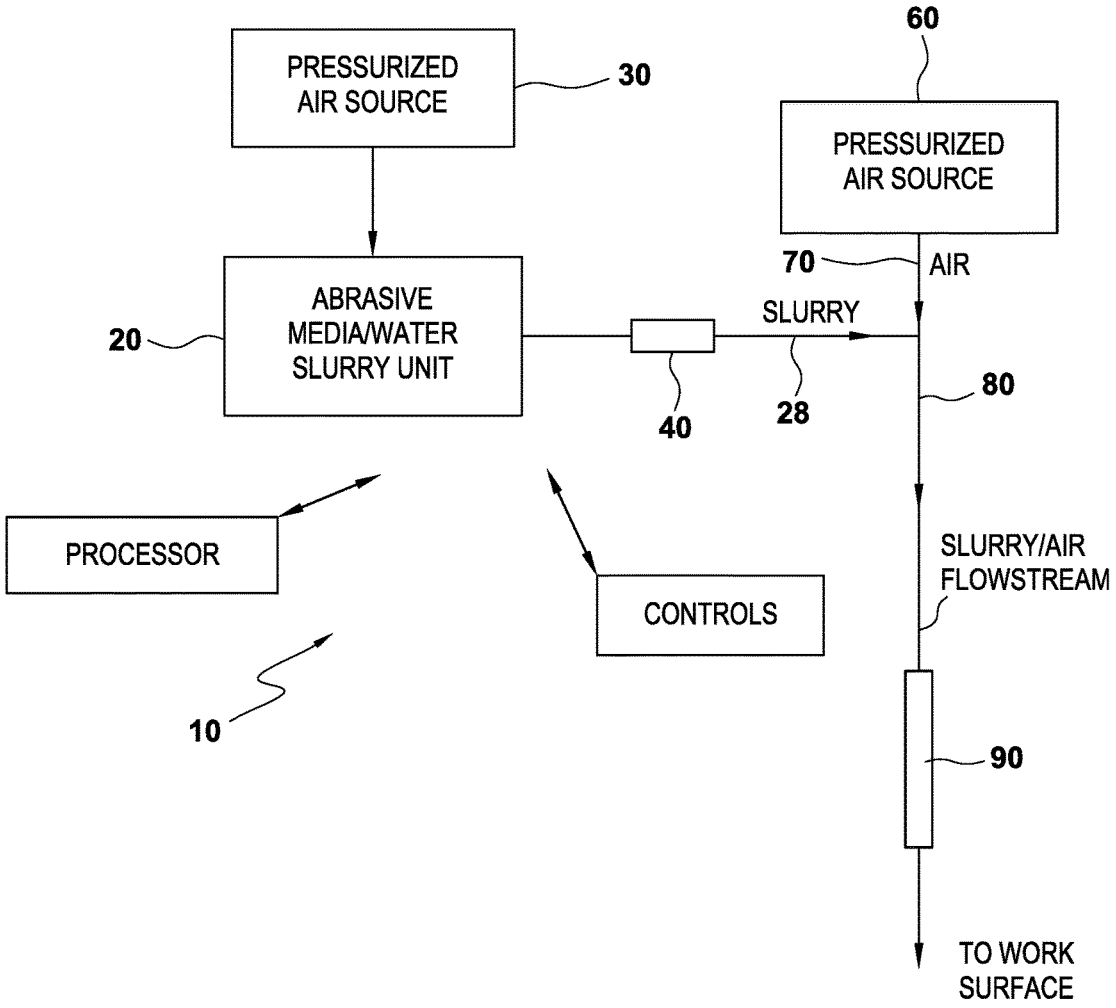
FIG. 1 illustrates, in schematic form, the abrasive media water blasting system embodying the principles of the present invention, including the sources and flowpaths for the abrasive media/water slurry stream, air stream, and combined abrasive water slurry and air stream, as being directed onto a work surface.

Referring to FIG. 1, a simplified schematic of various components of the abrasive media water blasting system 10 are set out. An abrasive media/water slurry unit 20 (described in detail below) feeds an abrasive media/water slurry into a pressurized air flowstream, which is flowing from a pressurized air source 60. Air delivery line 70 flows pressurized air. The resulting flowstream comprises encapsulated abrasive media particles in a water vapor mix, flowing through slurry delivery line 28, which is directed onto a work surface via a nozzle or wand. An adjustable metering valve 40 monitors and permits control of the abrasive media flow rate from the abrasive media/water slurry unit. Appropriate controls, monitoring equipment, piping, computer processor (if needed), and other elements known in the art are also provided, and are shown in schematical form. As described below, some or all of the components of the system are advantageously mounted on a skid for ease in handling. A controller 90 (which may be a wireless controller, described in more detail below) is held by the operator.

Figure 1A:
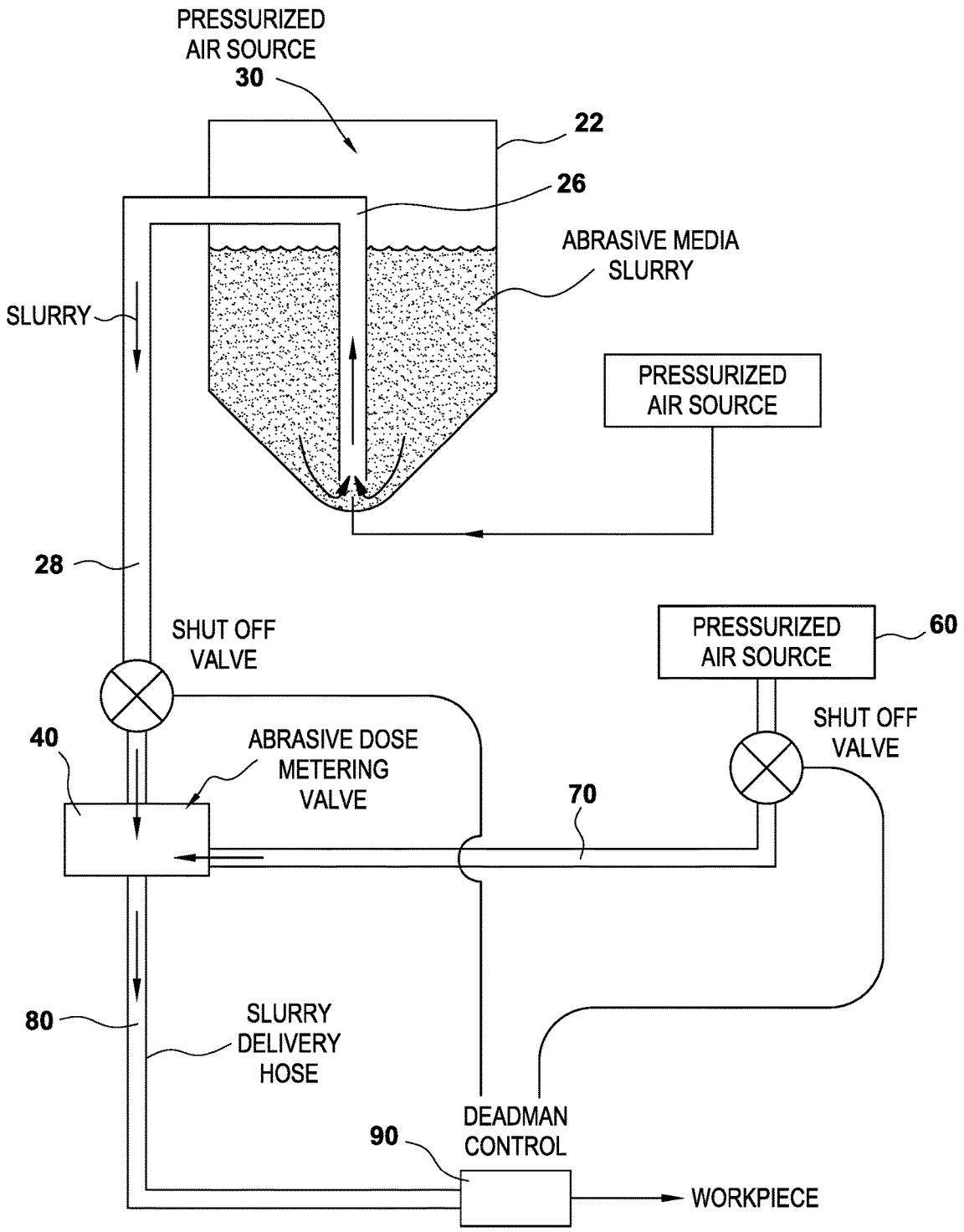
FIG. 1A shows additional detail of certain elements of an embodiment of the system.

FIG. 1A shows these various components in somewhat more detail. As can be seen, a so-called "deadman control" 90 is typically affixed to the blast hose and held by the operator, which in the preferred embodiment sends a wireless signal to valving to open or close same as needed in the job. An abrasive media slurry, labeled, is in place in abrasive media container 22.

Figure 2:
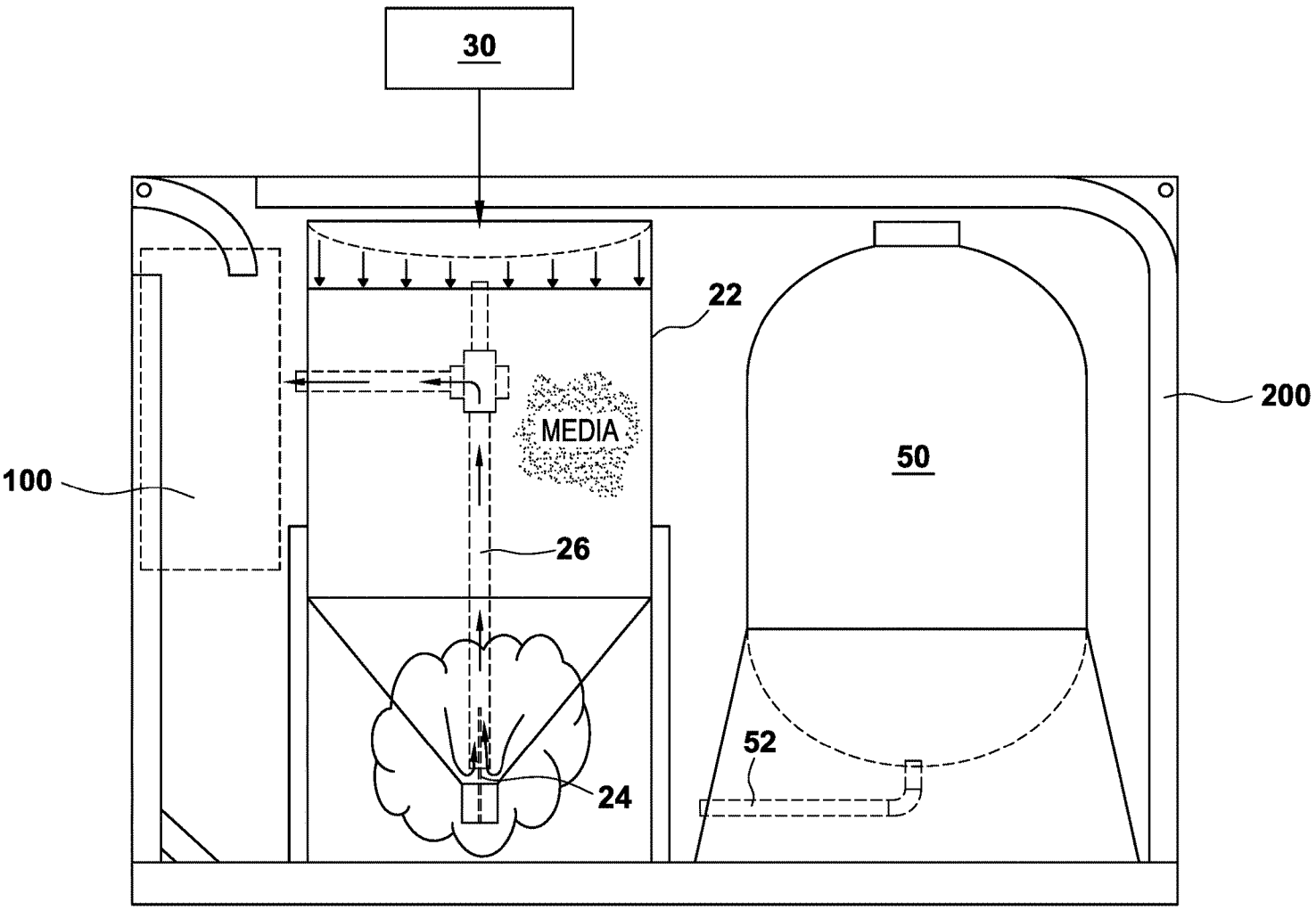
FIG. 2 is a view in partial cross section of one embodiment of the abrasive media water blasting system, mounted on a skid.
Figure 3:
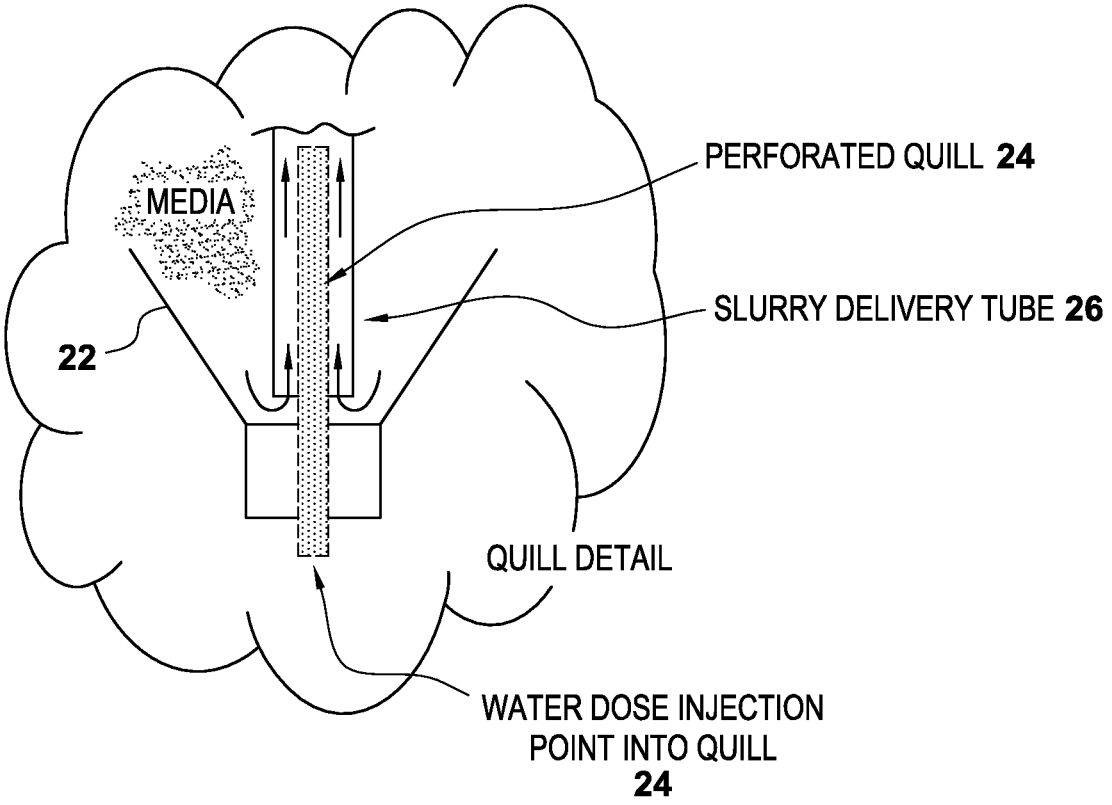
FIG. 3 is a more detailed cross section view of one embodiment of the present invention, showing the lowermost end of the abrasive media pot, and the placement of the perforated quill and slurry delivery tube within the abrasive media pot.

Referring to FIGS. 2 and 3, the system comprises an abrasive media container or "pot" 22 preferably disposed within a protective frame 200, with the bottom interior surface of pot 22 forming a downward-pointing cone (the vertex of the cone pointing downward). An abrasive media/water slurry delivery tube 26 is positioned vertically within pot 22, substantially centered within pot 22, with an outlet leading out of pot 22. A bottom end of slurry delivery tube 26 is spaced a suitable distance above the bottom of the vertex of the conical bottom of pot 22, as can be seen in the figures. A pressurized air source 30 provides pressurized air to the upper part of pot 22, as shown.

In one embodiment, as can be seen in FIG. 3, a perforated tube or quill 24 is positioned in bottom center point of pot 22, and extends upward a suitable distance into slurry delivery tube 26. Perforations are spaced out along the length, and around the circumference of, quill 24, as appropriate. It is to be understood that quill 24 is an optional element; depending upon the particular arrangement of other components, and the type/size of abrasive used, quill 24 may not be present in the system, or may take another form than set forth in FIG. 3.

When and if needed, pressurized water can be delivered from water vessel 50, via flow line 52, to quill 24, and the water flows upwardly through quill 24 and exits through the perforations.

Figure 4:
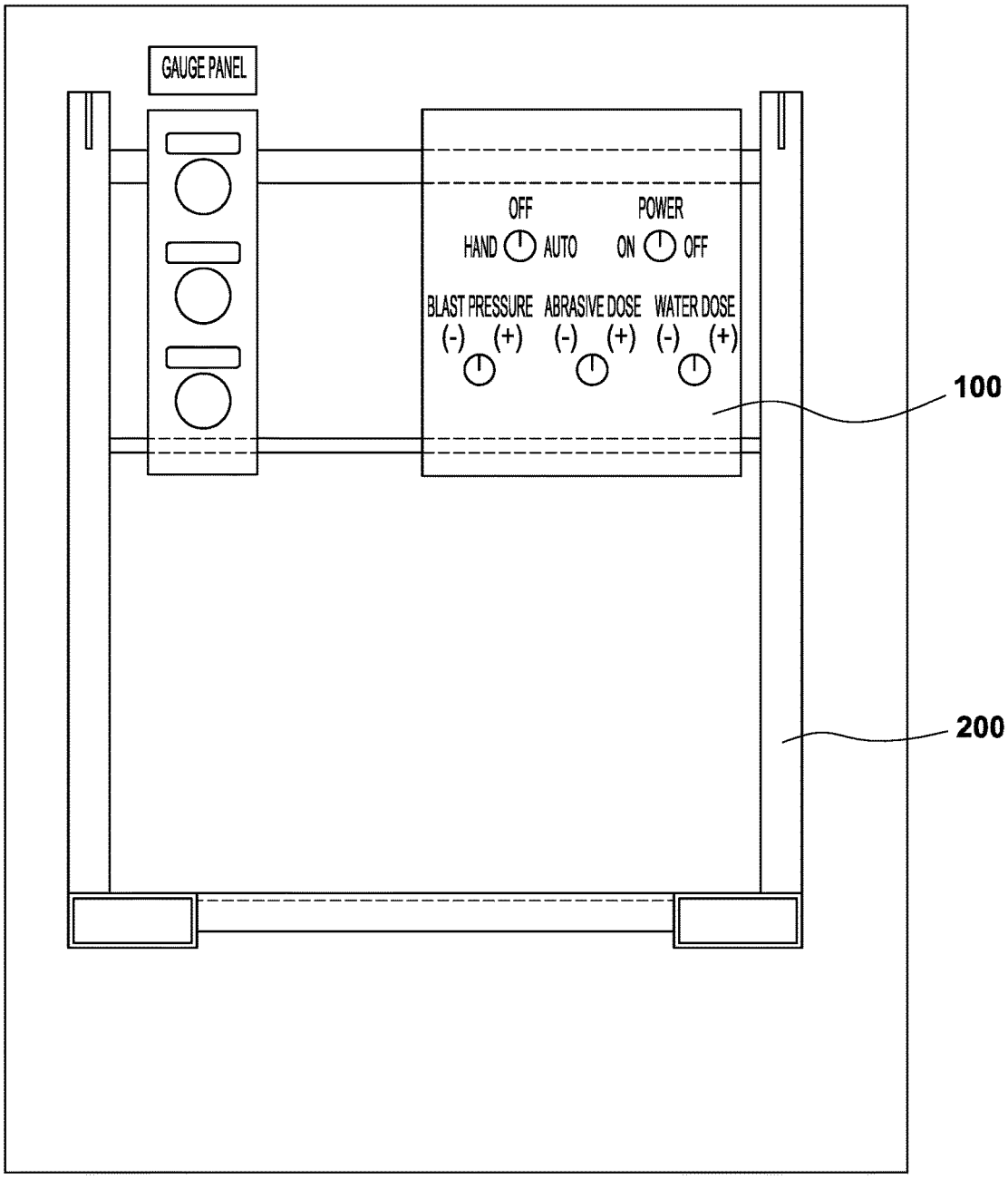
FIG. 4 is a view of the control panel, showing an exemplary layout of gauges, controls, etc.

As can be seen in FIG. 4, a control panel 100 provides a location for various controls monitoring and regulating the system operation. Pressure gauges, flow gauges, etc. as known in the art are provided.

Preferably, the various components of the system are contained on and within a frame 200, for ease in handling and to protect the various components.

Figure 5:
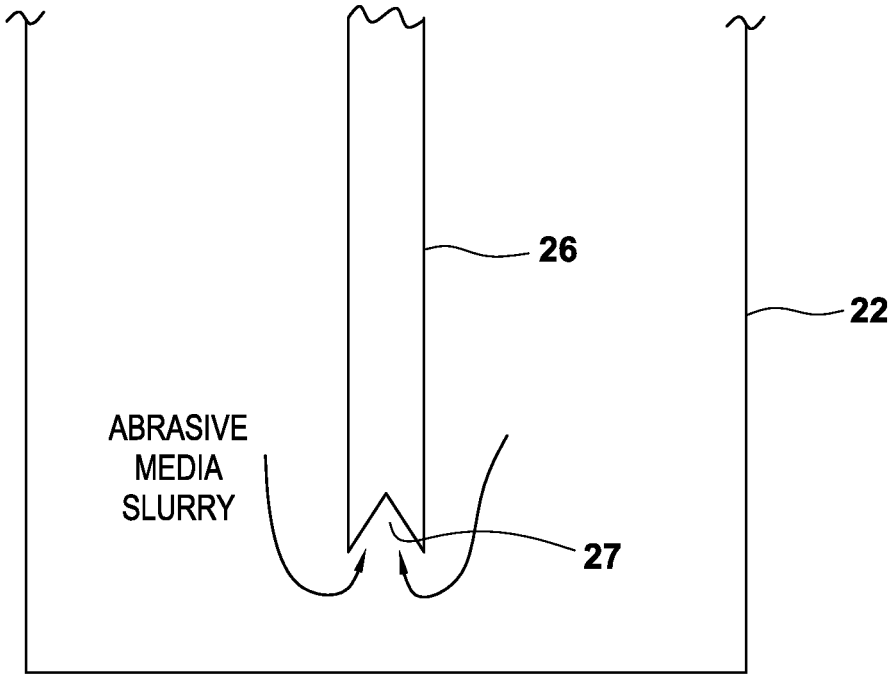
FIG. 5 is a cross section view of an embodiment of the interior of the abrasive media pot and lower end of the slurry delivery tube.
Figure 6:
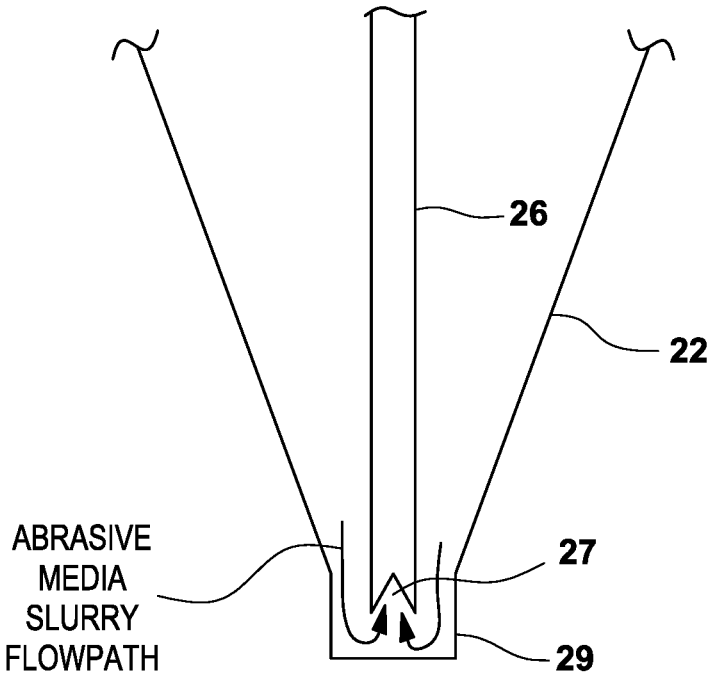
FIG. 6 is a cross section view of another embodiment of the interior of the abrasive media pot and lower end of the slurry delivery tube.

FIGS. 5 and 6 show additional detail of various aspects of an embodiment of pot 22 and slurry delivery tube 26. Fundamentally, slurry delivery tube 26 terminates a short distance, by way of example 1" to 2", above the bottom interior surface of pot 22. Preferably, the bottom end of slurry delivery tube 26 comprises a V-shaped cutout 27 to assist in avoiding plugging of the tube. Still further detail of one preferred embodiment is shown in FIG. 6, wherein the lowermost end of slurry delivery tube 26 is disposed in a short cylindrical section 29 at the bottom of pot 22. Representative dimensions of slurry delivery tube 26 are 1" outer diameter, positioned within the cylindrical section 29 of 1¼" inner diameter. It is understood that other dimensions are possible. It is to be understood that in a preferred embodiment, the inner bottom surface of pot 22 is of a downward facing cone, thereby tending to funnel the abrasive slurry to the open bottom end of slurry delivery tube 26, but that shape is not necessary and other arrangements could be used as well.

Figure 7:
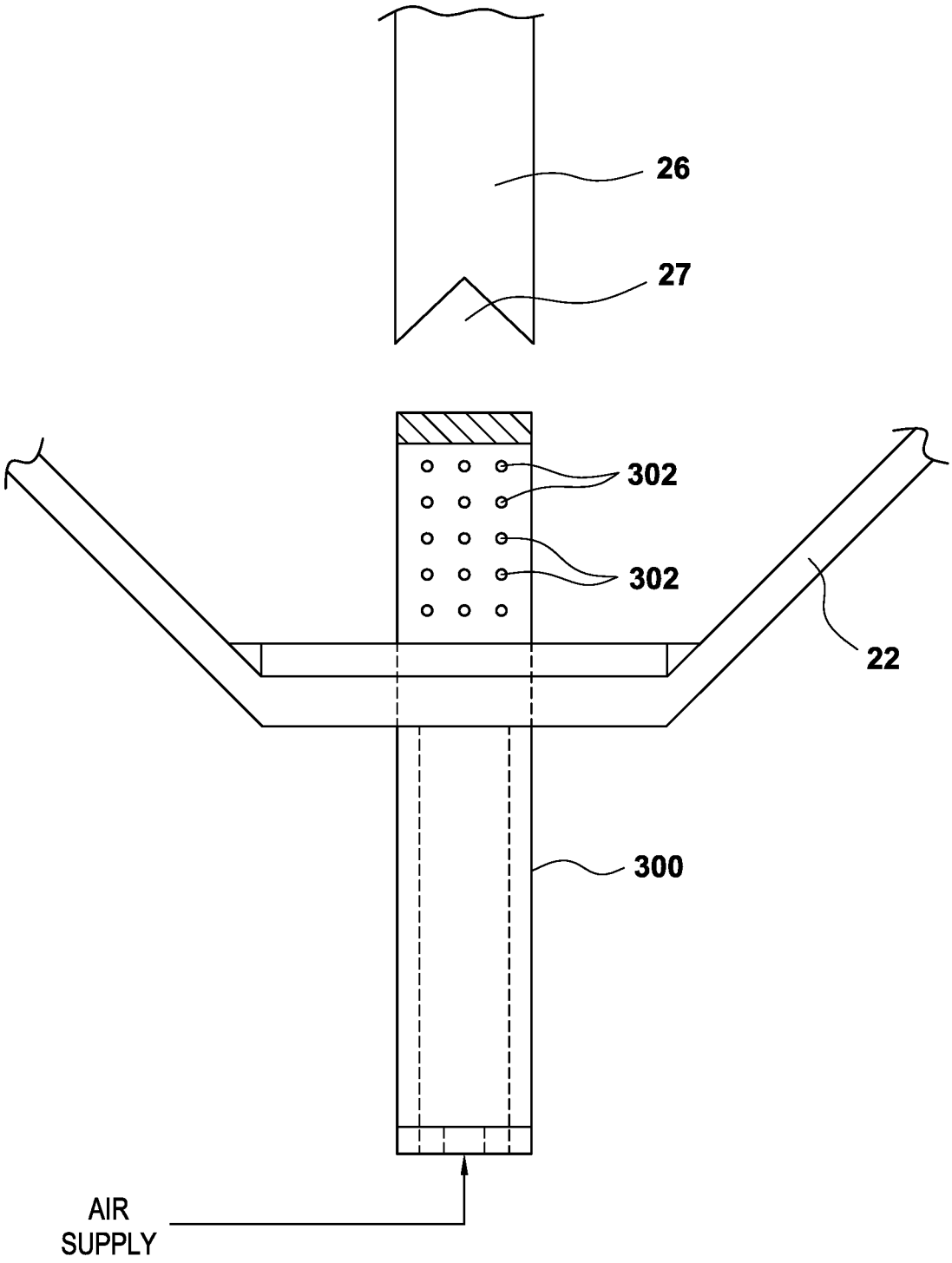
FIG. 7 is a cross section view of an embodiment of the interior of the abrasive media pot and lower end of the slurry delivery tube, also showing the placement of the perforated pressurized air delivery tube.
Figure 8:
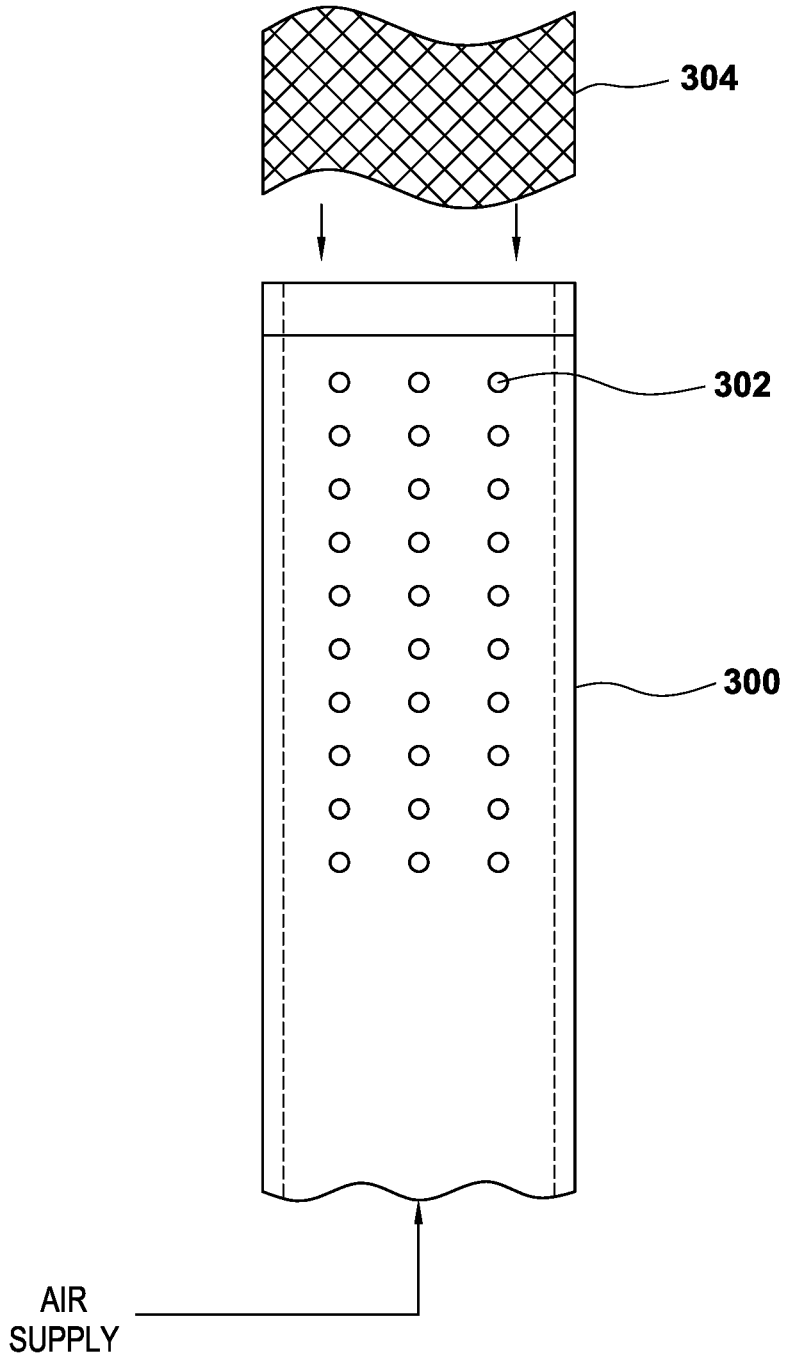
FIG. 8 shows additional detail of the perforated pressurized air delivery tube.

FIGS. 7 and 8 show detail of another possible embodiment, in which a pressurized air supply agitator is used to aid in avoiding clogging of the abrasive media slurry as it enters the slurry delivery tube and maintaining steady flow. An air delivery tube 300 is positioned in the lowermost part of pot 22, for example in the bottom center of the conically shaped bottom, and extends upwardly into pot 22. The uppermost end of air delivery tube 300 terminates a short distance below the lowermost end of slurry delivery tube 26, as seen in FIG. 7. An air supply is connected via hosing, etc. to air delivery tube 300, to permit air injection through same. Air delivery tube 300 comprises one or more perforations 302 therein. Referring to FIG. 8, additional detail regarding a preferred embodiment of air delivery tube 300 is shown. Preferably, air delivery tube 300 is a section of tubing, e.g. stainless steel tubing, with a perforated upper section comprising a plurality of holes 302 therethrough. A very fine mesh screen 304 (e.g. 600 mesh stainless steel screen) is disposed within the perforated section to prevent solids entry therein. As is described later herein, pressurized air (or other gas) may be injected through the air delivery tube 300 to (in effect) agitate the slurry, essentially at the point of its entry into the lower end of slurry delivery tube 26, and prevent clogging.

It is to be noted that the system is capable of handling a broad range of mesh sizes of abrasive (e.g. 500 mesh to 80 mesh), under widely variable pressure/velocity ranges, with little clogging.

Use of the System

To use the system, pot 22 is filled with a desired volume of abrasive media, such as garnet (which may be in an ultrafine particle size), or any other suitable abrasive media, along with a quantity of water, sufficient to make a slurry of abrasive media and water. It is understood that in some settings, dry blasting (i.e. without the addition of water or other liquid) is desired, and the present system is capable of dry blasting as well. Pot 22 is then closed and sealed. Air pressure (from pressurized air source 30) is applied to pot 22, which as can be seen in the drawings may have some void space therein at its upper end. It is to be understood that air pressure can be applied to an upper portion of pot 22, or at any other location, so as to create a pressurized environment within pot 22. A typical air pressure is approximately 90 psig. The air pressure within pot 22 creates a generally pressured environment within the pot. When a relatively lower pressure is created within slurry delivery tube 26 by opening of appropriate valving in the slurry delivery hose, etc., the relatively higher pressure within pot 22 pushes the slurry downward to the bottom of pot 22, where it then enters the lower end of slurry delivery tube 26, and then ("turning the corner") moves vertically upward within slurry delivery tube 26. This flowpath can be seen in FIGS. 1A, 2 and 3. The slurry then exits pot 22 through slurry delivery tube 26 (in the direction of the arrows), flowing through adjustable metering valve 40, then flowing on through slurry delivery line 28 and into the pressurized air flowstream in air delivery line 70 as earlier described. It is understood that the abrasive media/water slurry flow is induced by the pressure differential between the pressure within pot 22 (relatively higher) and the pressure within slurry delivery tube 26 (relatively lower). The resulting abrasive media/water/air stream flows through delivery line 80, to nozzle/wand 90.

The abrasive media/water/air flowstream is then directed at the work surface as desired. The type and size of abrasive media, and the relative volume of water in the slurry can be adjusted to yield the desired surface profile on the work surface. If desired, chemical additions may be made to the water to inhibit corrosion or yield other desired work surface treatment.

As described above, in certain embodiments quill 24 is present. In that event, in the event of any clogging of the slurry feed into the slurry delivery tube, and/or the slurry delivery tube, pressurized water can be flowed from water vessel 50 into pot 22 through perforated quill 24, which will aid in dislodging any clogging. In addition, if a higher relative amount of water is desired in the abrasive media/water slurry, additional water can be flowed in through perforated quill 24.

In the embodiments in which air delivery tube 300 is provided, when needed pressurized air (or other gas) can be injected into the lowermost part of pot 22, to agitate the slurry and prevent clogging.

A pressurized air source 30, which may be provided by a compressor or similar means, is provided to supply pressurized air to pot 22. A further pressurized air source 60 is provided to supply pressurized air for the delivery stream (i.e. the pressurized air stream which picks up the abrasive media/water slurry, for delivery to the work surface), which flows through a delivery tube or hose through a fluid delivery controller system, existing (typically through a nozzle) onto a workpiece. Piping, controls, central processing unit, wireless unit, etc. all as required are also provided.

The above described abrasive media water blasting system embodies several novel attributes, yielding benefits over prior art units, some of which by example include:

- the flowpath for the abrasive media/water slurry is upward through the slurry delivery tube and out of the pot (a "reverse flow"), as opposed to prior art systems which force the slurry downwardly out of the pot;
- the slurry delivery tube may be adjusted or changed in diameter, for example between ½" and 1" ID
- pressure within the pot, created by pressurized air rather than water pressure created by a complex pumping and valve system, is used to move the slurry out of the pot
- the pot pressure/blast pressure differential is relatively high (on the order of 90 psig), much higher than prior art units using water, which operate at 2-4 psig; also, the pressure differential can be readily adjusted to fine tune the slurry delivery, and compensate for a wide range of abrasive media type and size

Wireless Fluid Delivery Controller ("Deadman Controller")

As described above, the abrasive mixture is sent through a tube or hose, exiting the hose through a nozzle and directed onto a workpiece. The operator is typically holding the hose and/or nozzle, and is therefore frequently some distance away from the skid. Some form of fluid delivery controller system is manipulated by the operator to start/stop flow of the abrasive media stream.

Figure 9:
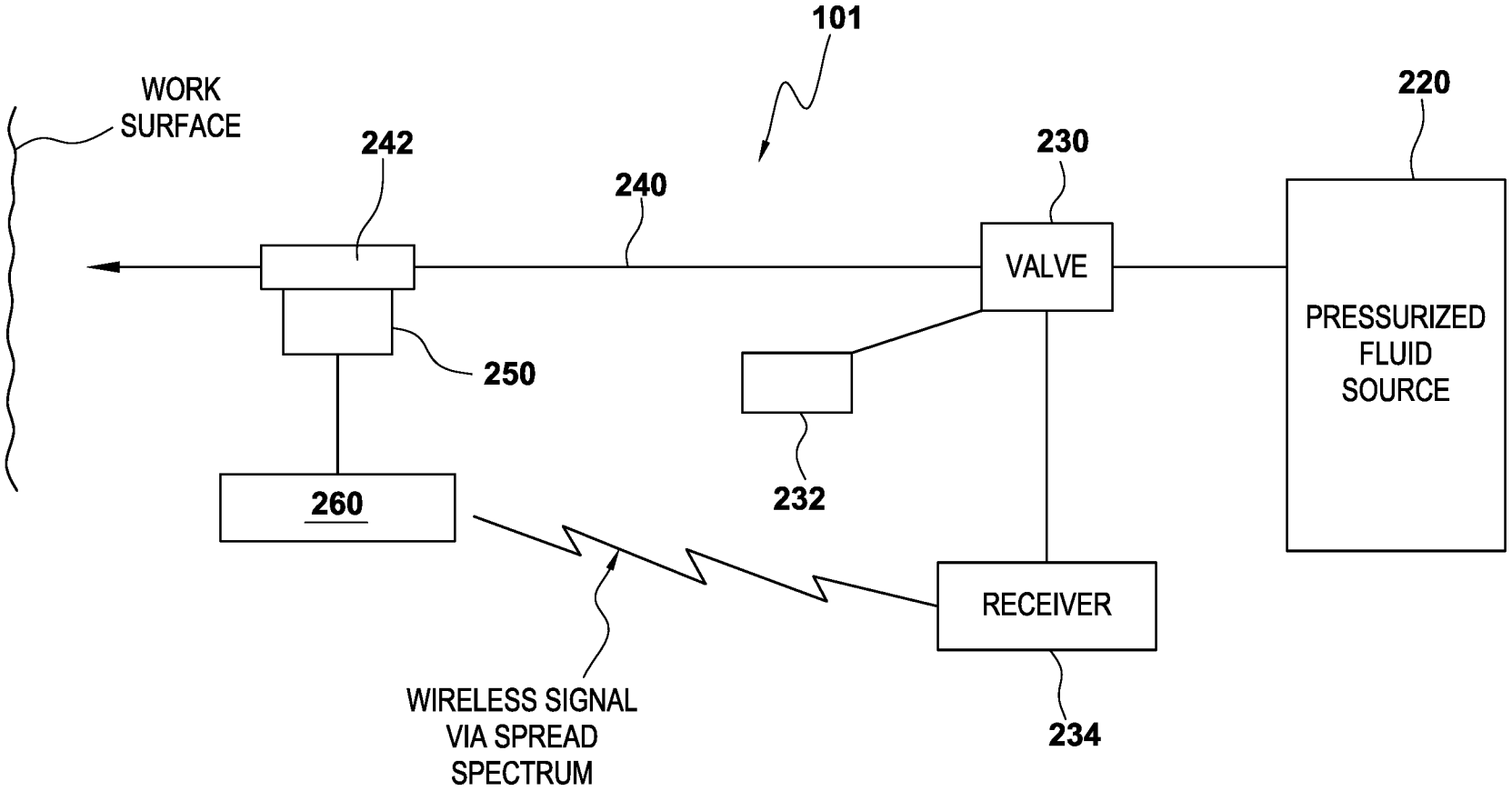
FIG. 9 is a schematic of the wireless fluid delivery controller system.
Figure 10:
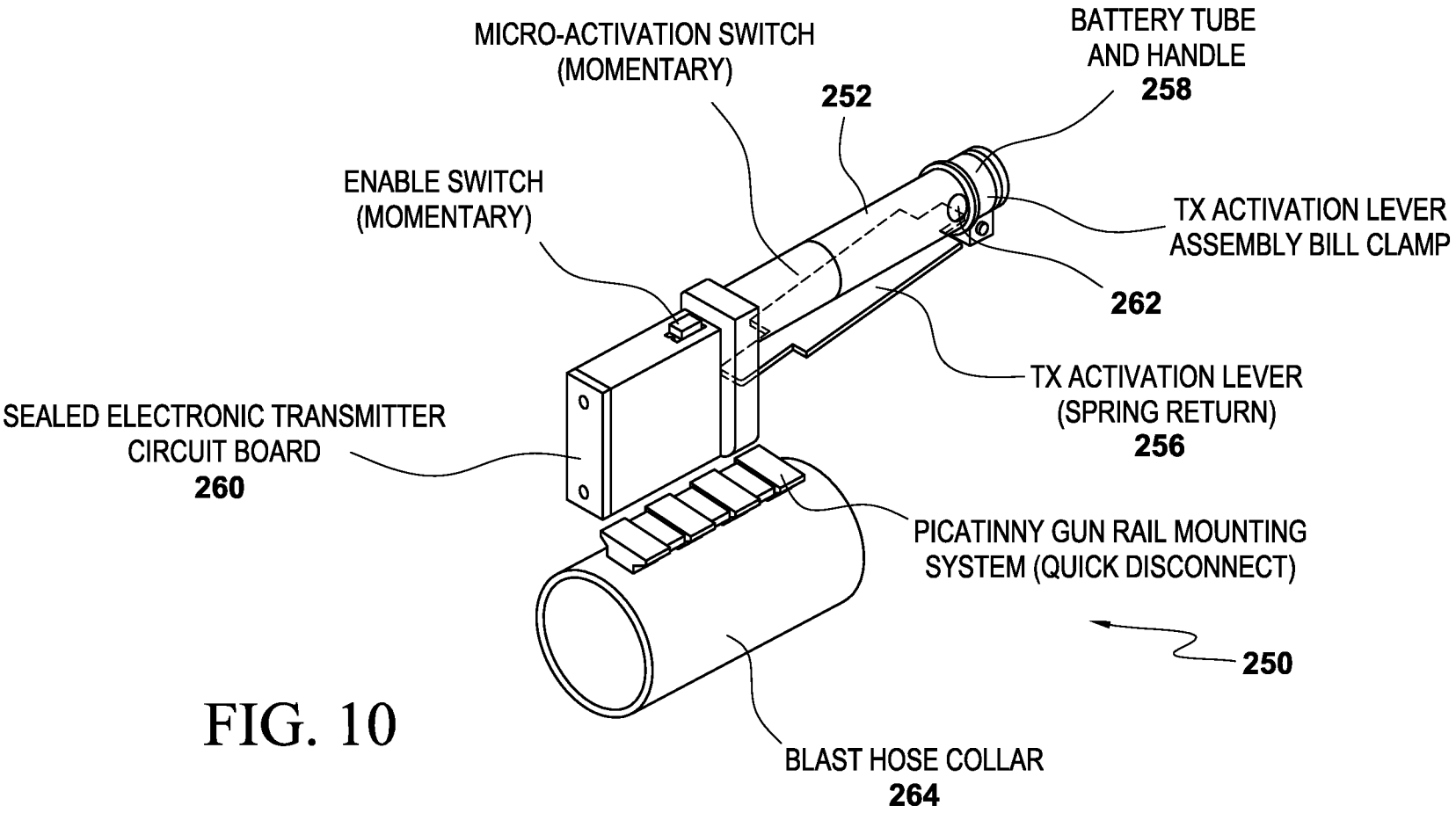
FIG. 10 is another view of one embodiment of the wireless fluid delivery controller.

Referring to FIGS. 9 and 10, various components of an embodiment of the fluid delivery controller system 101 are set out. A pressurized fluid source 220 may comprise an abrasive media slurry pot, pump, etc., as is appropriate for the desired use; one embodiment is set out in the foregoing description. Note that the pressurized fluid source may also comprise a pressurized gas source, such as a pipeline, pressurized tank, etc. The fluid delivery controller system may be used in conjunction with any pressurized fluid stream (whether or not containing any type of abrasive or solids) source for same.

The pressurized fluid flows from pressurized fluid source 220 through a valve 230. A valve actuator 232 interfaces with a receiver 234, with the receiver transmitting an appropriate signal to valve actuator 232 to open and close valve 230 as needed.

Downstream of valve 230, the pressurized fluid flows through hose 240 to controller 250, positioned proximal the end of hose 240. A nozzle 242 focuses the pressurized fluid stream onto the work surface.

Controller 250 comprises a transmitter 260, which sends a wireless signal to receiver 234, which in turn signals valve actuator 232 to open and close valve 230. A trigger or lever on controller 250 must be depressed by the operator to send the appropriate signal to receiver 234 and hence to valve 230 to permit fluid flow.

With reference to FIG. 10, an embodiment of controller 250 comprises a handle 252 attached to a sealed circuit board 260. A hose receiver 264 provides a receptacle for the hose, which is carrying the pressurized abrasive media slurry stream or other fluid, can be fixed and attached to controller 250 by a quick release rail system (e.g a "picatinny rail") or other suitable means. A lever 256 disposed on handle 252 provides the required control for the operator. Batteries, carried in battery tube 258 provides electrical power to transmitter board 260 (which may be a 2.4 GHz transmitter board). It is understood that when handle 252 is held down by the operator, then a switch is activated, for example a waterproof strip switch, which is connected to transmitter board 260, and sends the wireless signal to receiver 234. A spring 262, which may be a non-metallic spring, biases handle 252 to a non-actuated position, so that when the operator intentionally relaxes the holding-down of handle 252, or if controller 250 is dropped, etc., then the required signal from transmitter 260 to receiver 234 ceases, valve 230 is therefore closed, and fluid flow ceases.

Yet another embodiment of controller 250 comprises the transmitter board 260 being carried on the operator's belt or the like. In this embodiment, a signal is sent from the hand held controller 250, to the transmitter board 260, thence to the receiver 234. This embodiment permits the hand-held part of the device to be smaller and lighter.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof.

Therefore, the scope of the invention is to be determined not by the illustrative examples set forth above, but by the appended claims and their legal equivalents.

We claim:

1. An abrasive media blasting system, comprising:

an abrasive media container comprising an interior bottom surface and an abrasive delivery tube disposed within said abrasive media container, said abrasive delivery tube having an open bottom end positioned at fixed operative distance above said interior bottom surface, and a discharge end positioned outside of said container;

a variable pressure gas source connected to said abrasive media container, so as to pressurize said abrasive media container with gas, and a first controller controlling said pressure of said variable pressure gas source;

a variable pressure air supply line comprising an air supply valve and a second controller for controlling flow and pressure of air flowing through said variable pressure air supply line;

an abrasive metering/shutoff valve connected to said discharge end of said abrasive delivery tube and to said variable pressure air supply line downstream of said air supply valve, said abrasive metering/shutoff valve controlling a flow rate of an abrasive media from said abrasive media container and permitting the mixing of said abrasive media flow from said abrasive delivery tube and said variable pressure air supply line at desired respective rates;

whereby upon activation of said second controller and activation of said abrasive metering/shutoff valve, gas pressure within said container forces an abrasive media slurry disposed within said container downward within said container, through said open bottom end of said delivery tube, and upward through said delivery tube and out said discharge end thereof, and whereby the gas pressure within said container, the pressure of said pressurized air supply line, and the rate of flow of said abrasive media may be independently controlled so as to yield an abrasive discharge stream having a desired pressure and flowrate.

2. The abrasive media blasting system of claim 1, wherein said second controller and said abrasive metering/shutoff valve are controlled via a wireless connection to a hand held unit.

3. The abrasive media blasting system of claim 1, wherein said interior bottom surface of said abrasive media container tapers downwardly to a cylindrical section, and wherein said open bottom end of said media delivery tube is positioned within said cylindrical section.

4. The abrasive media blasting system of claim 3, wherein said open bottom end of said media delivery tube comprises an inverted V-shaped cutout.

5. The abrasive media blasting system of claim 1, wherein said interior bottom surface of said abrasive media container tapers downwardly to a terminus, said open bottom end of said abrasive delivery tube positioned at an operative distance above said terminus, and further comprising a pressurized gas delivery tube disposed in said container below said open bottom end of said abrasive delivery tube, said pressurized gas delivery tube comprising one or more holes through which a pressurized gas may be injected into said container below said open bottom end of said abrasive slurry delivery tube.

6. A method of abrasive blasting, comprising the steps of:

a) providing an abrasive blasting unit comprising an abrasive media container, said abrasive media container comprising:

an interior bottom surface;

an abrasive delivery tube disposed within said abrasive media container, said abrasive delivery tube having an open bottom end positioned at a fixed operative distance above said interior bottom surface, and a discharge end positioned outside of said abrasive media container, whereby air pressure within said abrasive media container will force an abrasive media within said abrasive media container downward within said abrasive media container, through said open bottom end of said abrasive delivery tube, and upward through said abrasive delivery tube and out said discharge end thereof;

b) placing a desired volume of abrasive material within said abrasive media container, along with a desired volume of water, forming a slurry therein;

c) creating pressure within said abrasive media container by applying pressurized air within;

d) creating a relatively lower pressure within said abrasive slurry delivery tube, thereby moving said slurry downwardly in said abrasive media container and into said open bottom end of said abrasive slurry delivery tube, then upwardly through said abrasive slurry delivery tube and through said discharge end;

e) providing a pressurized air stream;

f) mixing said pressurized air stream and said slurry from said abrasive slurry delivery tube under desired conditions, then directing said combined pressurized air stream and said slurry onto a workpiece.

* * * * *